United States Patent [19]

Rello

[11] 4,277,187

[45] Jul. 7, 1981

[54] RIBBON LOCATING MEANS

[75] Inventor: Michael J. Rello, Willow Grove, Pa.

[73] Assignee: Exxon Research & Engineering Co., Florham Park, N.J.

[21] Appl. No.: 61,454

[22] Filed: Jul. 27, 1979

[51] Int. Cl.[3] ..... B41J 35/04; B41J 32/00

[52] U.S. Cl. ..... 400/248; 400/208

[58] Field of Search ..... 400/194–196.1, 400/207, 208, 247, 248, 248.1, 692, 694; 24/255 R, 255 SL, 255 BS

[56] References Cited

U.S. PATENT DOCUMENTS

| | | | |
|---|---|---|---|
| 3,733,656 | 5/1973 | Stalder | 24/255 R X |
| 3,986,593 | 10/1976 | Orlens et al. | 400/175 X |
| 4,047,608 | 9/1977 | Willcox | 400/248 X |
| 4,203,676 | 5/1980 | Hatsell | 400/208 |

FOREIGN PATENT DOCUMENTS

| | | | |
|---|---|---|---|
| 2019648 | 11/1971 | Fed. Rep. of Germany | 400/248 |

*Primary Examiner*—Paul T. Sewell

*Attorney, Agent, or Firm*—Norman L. Norris

[57] ABSTRACT

This invention relates to location of thin ribbons or webs with respect to predetermined locations. More specifically, the invention relates to improved ribbon locating budge whereby an inked typewriter ribbon is located in proximity to an impact hammer for impacting the ribbon into a paper or other print receiving medium.

15 Claims, 8 Drawing Figures

RIBBON LOCATING MEANS

FIELD OF THE INVENTION

This invention relates to location of thin ribbons or webs with respect to predetermined locations. More specifically, the invention relates to improved ribbon locating means whereby an inked typewriter ribbon is located in proximity to an impact hammer for impacting the ribbon into a paper or other print receiving medium.

BACKGROUND OF THE INVENTION

At the time the typewriter was originally invented, the limiting factor in printing speed was that of the operator. Therefore, the object of design of improvements to early typewriters was means for improving the speed at which the operator could work; that is to say, the speed of operation of such an early typewriter was limited by the rate of data input to it by an operator. Today, the situation is reversed. Digital data processing methods have enabled data to be inputted into a typing or printing machine far faster than the mechanical operations of the machine can be performed. It has therefore been a continuous object of the typewriter and word processor art to improve the speed at which such data can be output onto paper. To this end, the printing industry has made substantial refinements. One refinement which is now well known is to move the impact means with respect to the stationary platen, rather than move the platen with respect to the impact means, since the impact means is generally of lighter weight and therefore possesses less inertia and can consequently be moved faster. A further refinement which has been introduced and which is the subject of co-pending application Ser. No. 833,270 filed Sept. 14, 1977, is to hold the bulk of the printing ribbon and ribbon supply apparatus stationary with respect to the typing machine and only move a small fraction of ribbon exposed in the vicinity of the impact means. In this way, the amount of ribbon weight which must be moved is considerably lowered, thus enabling improvements in the printing speed of the machine. Clearly, flexible leader means must be devised to convey ribbon between a stationary ribbon cartridge and a moving print point. Leaders which have been developed are the subject of co-pending applications Ser. No. 833,257, filed Sept. 14, 1977, Ser. No. 061,880, filed July 30, 1979 and Ser. No. 092,690, filed Nov. 9, 1979.

Parallel to the development of improvements in speed of printing apparatus, specifically including typewriters, have been the improvements made in the convenience of operation of such machines. In particular, it will be appreciated that an inked typewriter ribbon can be a very messy object to handle with one's hands. Hence, it has been an object of the art to develop a type ribbon-containing cartridge which can be snapped in and out of the machine with a minimum of time and effort expended and without coming into contact with the fingers of the operator or other parts of the machine, thus limiting the amount of ink which is rubbed off on various parts of the machine as well as on the print receiving medium or paper. In the context of the stationary cartridge/movable print point application discussed above, it is apparent that there existed a need for a ribbon exposing means which would hold the ribbon in such a way as to make it readily attachable to the machine for printing and which would be readily demountable when a ribbon was exhausted, but which would further not require any threading of the ribbon by the operator; desirably, a snap-in or-out mechanism needed to be provided. Such a ribbon locating means is disclosed in co-pending application Ser. No. 833,352, filed Sept. 14, 1977, now U.S. Pat. No. 4,203,676. The present application involves improvements made thereto, in particular, the present application discloses an improved ribbon locating bridge designed for use with the flexible leader which is the subject of co-pending application Ser. No. 061,880, filed July 30, 1979.

OBJECTS OF THE INVENTION

It is therefore an object of the invention to provide improved ribbon locating means for exposing a portion of a ribbon so that it may be acted on at a given point of use.

It is a further object of the invention to provide ribbon locating means which is so adapted as to be readily mountable and demountable by an operator without requiring the necessity of threading ribbon through guides or the like.

A further object of the invention is to provide a ribbon locating means which can be made in essentially one piece for simplicity yet which is well suited to provide ready mounting and demounting without the necessity of threading ribbon around guides.

Finally, it is an object of the invention to provide a ribbon locating means which can be readily and economically made of inexpensive materials yet which satisfies the other above-listed objects of the invention.

SUMMARY OF THE INVENTION

The present invention satisfies the needs of the art and the objects of the invention listed above by its provision of a bridge means comprising end portions for detachable mating with mounting structure on a printing machine, these end portions being molded of resilient plastic material and having finger contacting locations therein whereby upon application of a moderate amount of pressure by the fingers of an operator, the bridge can be detached from the bridge mounting means. In a preferred embodiment, the ends of the bridge locating means comprise predetermined regions of flexure such that the pressure exerted by the operator's fingers causes flexure of a portion of the bridge whereby it may be released from mounting structure for detachment of the bridge from the printing machine.

BRIEF DESCRIPTION OF THE DRAWING

The invention will be better understood if reference is made to the accompanying drawings in which.

DESCRIPTION OF THE PREFERRED EMBODIMENTS

Figure 1:
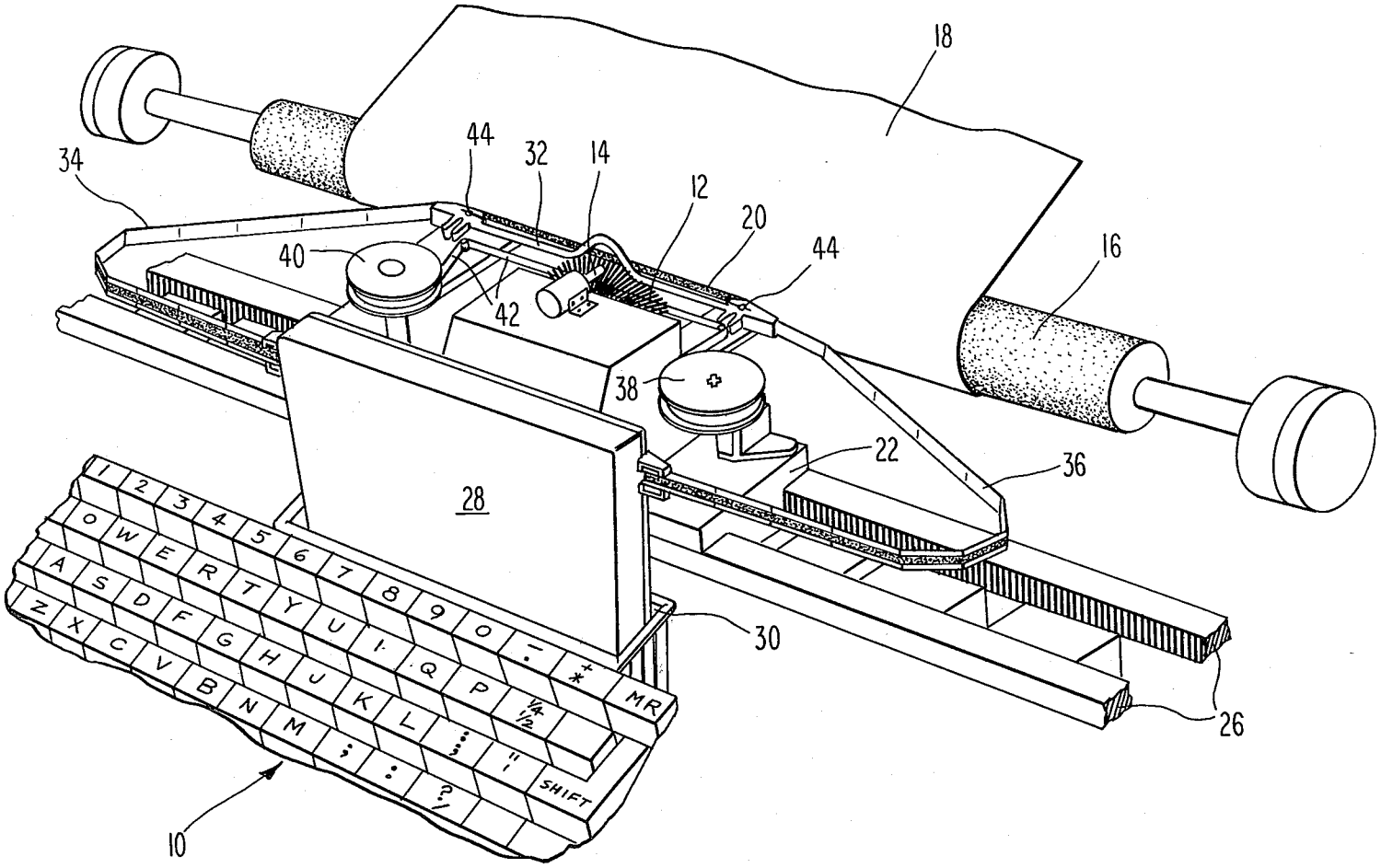
FIG. 1 represents an overall view of the ribbon locating means of the invention in its intended environment, i.e. a typewriter.

Referring now to FIG. 1, an overall view of the ribbon locating means of the invention is shown as it may be adapted for use in a typewriter. The typewriter is shown as comprising a keyboard 10 composed of a multiplicity of character control keys which control, inter alia, the motion of a print wheel 12. Print wheel 12 may desirably be composed of a number of spokes each having a character element formed at one end thereof, which when impacted by a hammer 14 are driven into a ribbon 20 producing a mark corresponding to the character selected on a print receiving medium or paper 18 supported by a platen 16. As discussed above, it is desirable that the print wheel 12, hammer 14 and part of the ribbon 20 move with respect to the platen 16; to achieve this end, these elements are mounted on a carriage 22 which is driven back and forth with respect to the platen 16, preferably by a stepper motor 26. A cartridge 28 holds ribbon 20 for typing, which is guided to the print point defined by the hammer 14 by means of a first flexible leader 34 and returned to the cartridge 28 by a second flexible leader 36. A portion of ribbon 20 may be exposed in the region of the hammer 14 by bridge ribbon locating means 32. This bridge locating means 32 is mounted on two pins 44 by methods which will be discussed in further detail below. It will be observed that the ribbon 20 is shown as somewhat below the print point defined by the hammer 14. This is so the operator of the machine can see what he or she has typed. In operation, the ribbon 20 is lifted by lifter means including pins 44 when it is desired to type and immediately thereafter return to its lowered position.

An erase ribbon arrangement may also be provided comprising an erase ribbon supply reel 38, an erase ribbon take-up reel 40 and an erase ribbon 42, which may be of either the "lift-off" or "overprint" types.

Figure 2:
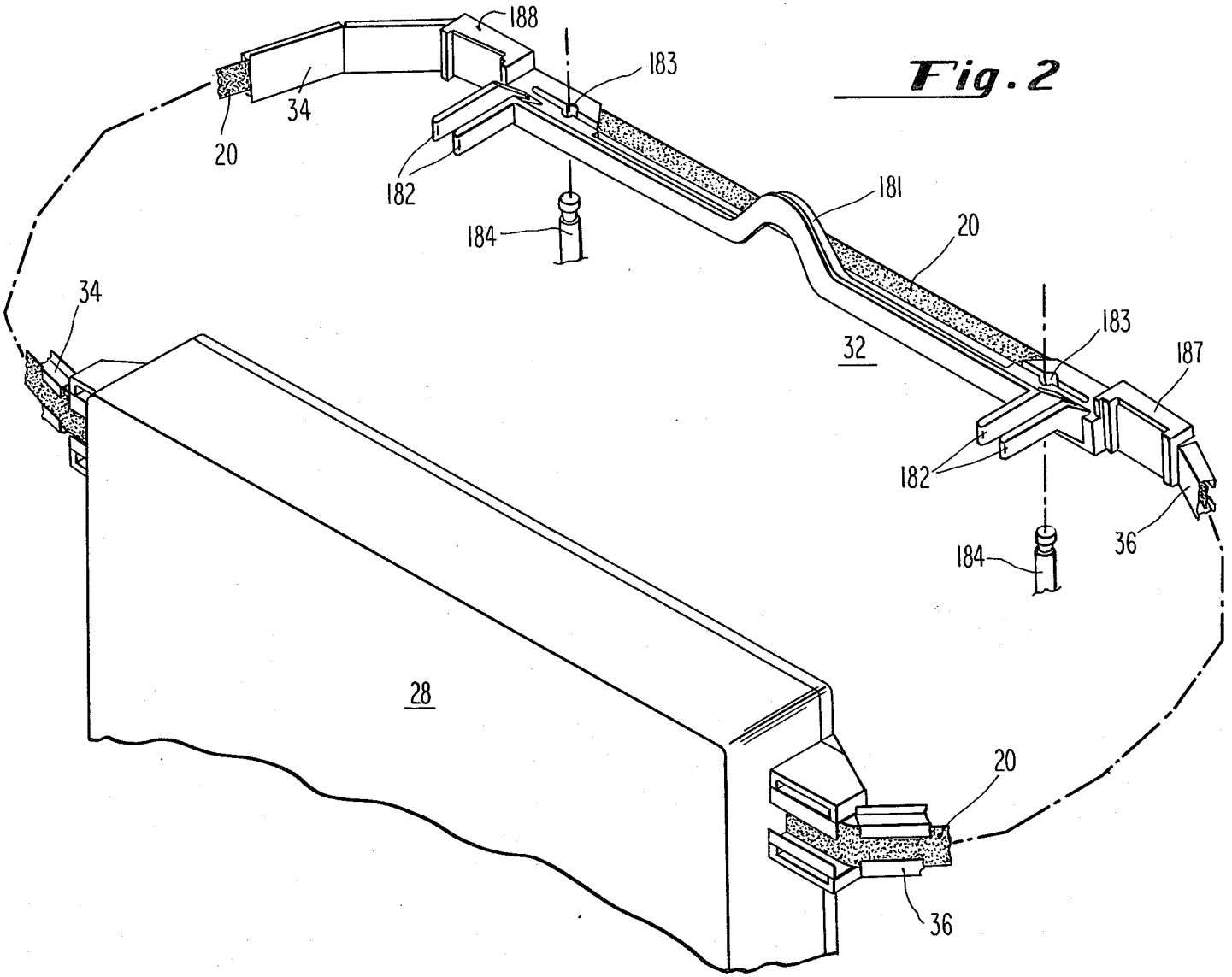
FIG. 2 shows an enlarged perspective view of the ribbon locating means of the invention in conjunction with flexible leaders and a ribbon supply cartridge.

Referring now to FIG. 2, an overall perspective view of the ribbon system of the invention is shown comprising a cartridge 28 in which ribbon is supplied, a first leader 34 through which ribbon 20 is passed on its way to the print point, where it is supported by locating bridge 32, and a second leader 36 returning ribbon 20 from the vicinity of the print point to the cartridge 28. As will be apparent, locating bridge means 32 is a substantially rigid member which exposes a portion of ribbon 20 so that it may be impacted by character elements 12 driven by hammer 14 so as to produce a corresponding mark on a paper 18 (FIG. 1). To this end, bridge means 32 is provided with an uplifted area 181 through which the hammer 14 and character element may pass on their way to impact ribbon 20. Other than this area, ribbon 20 is essentially enclosed by flexible leaders 34 and 36 while it is not stored in cartridge 28.

Bridge means 32 is desirably provided with notches 183 designed for ready mating with pins 184 which are mounted on ribbon lifter means on the typewriter so as to lift the ribbon 20 into position just prior to impact thereof by a character element. In this way, the ribbon 20 is not in the way of the view of an operator desiring to examine what has been typed. Preferably the bridge means 32 is provided with operator engaging finger portions 182 which are designed in such a way as to permit flexure of the bridge means 32 at a point such that the two halves of notches 183 are separated thus allowing their removal from the pins 184. Furthermore, the ends of the bridge locating means 32 are provided with attachment means 188 and 187 for attachment of the leader thereto so that a complete unit is formed. The cartridge 28 may similarly be provided with means for easy insertion and removal from a cartridge housing 30 (FIG. 1) so that the entire ribbon unit comprising cartridge 28, leaders 34, 36 and locating means 32 can be readily attached or removed from a typewriter.

Figure 3:
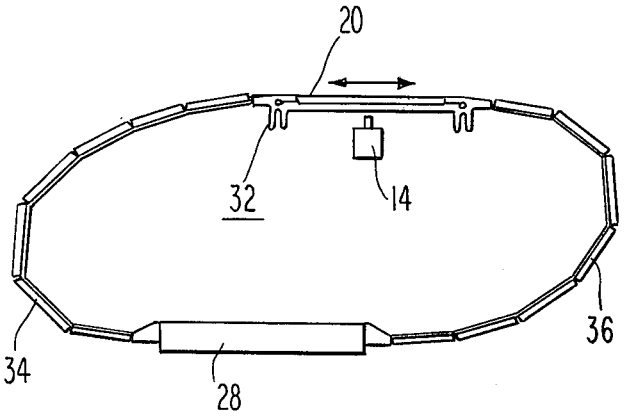
FIG. 3 shows a schematic view of the manner in which the flexible leaders allow the ribbon locating means of the invention to move with respect to the cartridge.

It will be observed that in FIGS. 1, 2 and 3 the leader 34 and 36 is shown as flexible at certain points. The design of the leaders 34 and 36 which permits this flexure is the subject matter of co-pending application Ser. No. 061,880, filed, July 30, 1979 and is an important feature of the invention. By the provision of such flexible leaders 34 and 36 the print point is permitted to move with respect to the cartridge 28, and the pins 184 are permitted to lift ribbon 20 into its print position. As shown in FIG. 3, the locating means 32 is as exemplified by arrows allowed to move back and forth with respect to a cartridge 28. The ribbon carried by the locating means therefor also moves, along with the print point which is exemplified by hammer 14 in FIG. 3. In this way, the bulk of the weight of ribbon 20, including ribbon housing 28 and the like is carried on the typewriter itself and is not required to move along with the print point. In this way, less total mass need be moved and therefore motion can be effected with greater speed.

Figure 4:
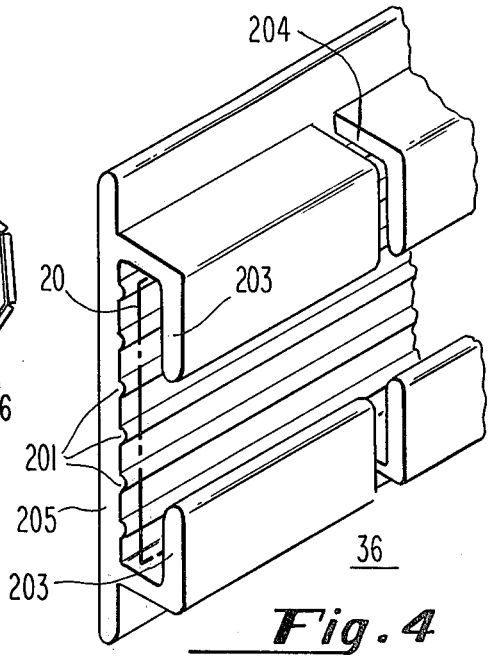
FIG. 4 shows an enlarged cross-section perspective view of the leader having the ribbon therein.

Referring to FIG. 4, an enlarged view of the leader 36 is shown. It will be understood that leader 34 is substantially the same. The leader 36 may comprise a one piece extrusion of plastics material designed for flexure at certain preselected points 204. At other points, the leader comprises a web section 205 and enclosing sections 203 which are designed to enclose the ribbon 20 therewithin. Longitudinally extending bumps or ridges 201 may be provided in order that the ribbon 20 does not make substantial contact with the web 205 which would cause considerable friction thereat. The L-shaped enclosing portions 203 are slit at predetermined intervals to provide slits 204. It will be understood that provision of these slits 204 allows the web 205 to flex in the vicinity of the slits 204, but only in the direction such that the upstanding portions 203 do not abut. That is to say, flexure of the leader 36 is restricted to flexure away from a linear path in only one direction. In this way, the path of the ribbon 20 can be assured to be essentially circular and not take a reverse bend at any point. Thus, the inked surface of the ribbon can be prevented from contacting any part of the leader, thus preventing its being defaced.

Figure 5A:
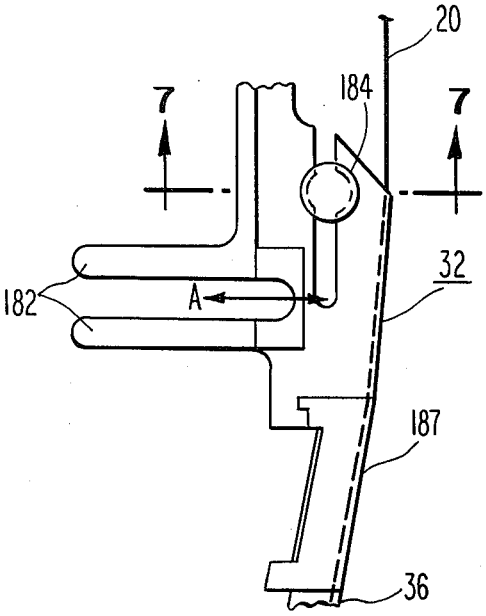
FIGS. 5*a* and 5*b* show how the ends of the ribbon locating means may be flexed in order that the locating means may be demounted from the typewriter.
Figure 5B:
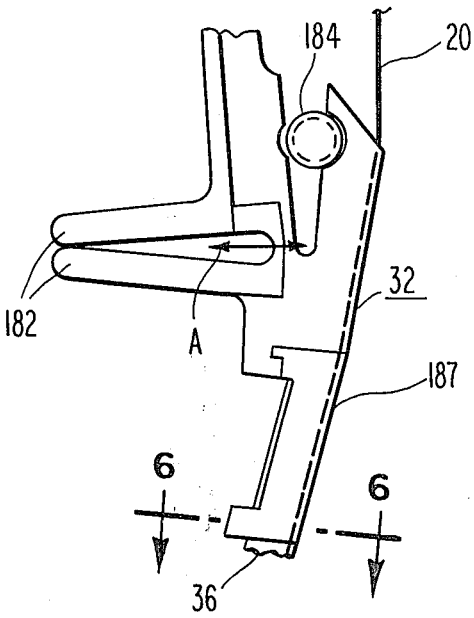

FIG. 5*a* shows one end of the locating bridge means 32 of the invention. In the figure, the right end of the locating means 32 shown in FIG. 2 is illustrated; it will be understood that the left end is substantially similar although inverted. It will be seen that the end of the locating means 32 is formed comprising a pair opposing of fingers 182 extending outwardly away from the ribbon on one side thereof, a notch or elongated opening extending parallel to the path of ribbon conveyance amounting to a split ring designed to engage a pin 184, and a leader attaching portion 187. The ribbon 20 is passed by the leader 36 into the leader attaching portion 187 and then passes out along the length of the ribbon locating means where it may be impacted by a character element under the action of the hammer 14. FIG. 5*b* shows a similar view of the right end of the locating means. However, it will be apparent from a comparison of FIGS. 5*a* and 5*b* that the fingers 182 have been pressed together in a direction parallel to ribbon conveyance, ordinarily under the action of the hand of the operator, in FIG. 5*b* permitting the end of the ribbon locating means to flex about a region A. It will be apparent that such flexure will take place only if region A is the weakest point at which a force is exerted by the operator's fingers. That is to say, for example, the fingers 182 must themselves be of a larger cross-sectional area than area A otherwise they would flex rather than A which would not produce the desired result, that being that the end of the locating means 32 be spread about pin 184 thus permitting the locating means 32 to be disengaged from the pin 184 and removed from the machine. It will therefore be apparent that FIG. 5*a* shows a locating means 32 in engagement with the machine, whereas FIG. 5*b* shows the locating means 32 disengaged and about to be removed from the machine. Locating means 32 can be made, preferably by molding, from any of a number of well-known plastic materials.

Figure 6:
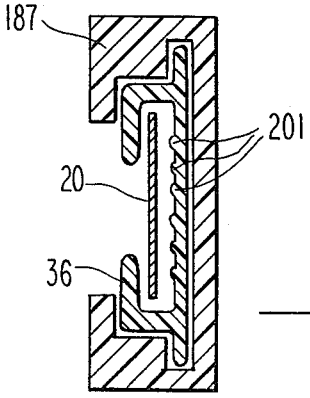
FIG. 6 shows a cross-sectional view taken along section line 6—6 of FIG. 5*b.

FIG. 6 shows a cross-sectional view of the end of the locator means 187 taken along line 6—6 shown in FIG. 5*b*. There it is seen how a leader 36 fits snugly within the end of the locator means 187 and how the ribbon 20 is carried therewithin separated from the bulk of the leader by bumps 201. It will be understood that since all the parts involved may desirably be made out of a relatively flexible plastic material it is a comparatively straightforward matter of design to design the end of the locator means 187 and the leader 36 so that these parts are a press fit together if such is desired. In other circumstances it may be desirable to adhesively bond these parts together or perhaps even to use a screw, rivet or the like.

Figure 7:
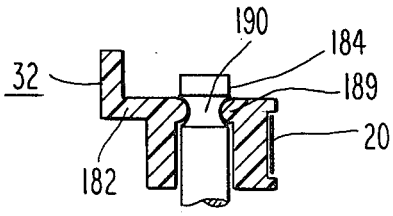
* and FIG. 7 shows a second cross-sectional view taken on line 7—7 of FIG. 5*a.*

FIG. 7 shows a second cross-sectional view of the end of the locater means 32, this time taken along line 7—7 of FIG. 5*a*. There it is seen how correspondingly shaped mating portions 190 and 189, of the pin 184 and the locater means 32, respectively, fit together so that the locater means 32 is firmly attached to the printing machine while being readily removable therefrom as shown in FIG. 5*b*. In particular, the pin 184 may comprise a section of reduced radius 190 which may be adapted to mate with a portion of the locater means 189 of slightly narrower diameter than the larger dimension of pin 184, whereby the locater means 32 may be firmly affixed therein.

It will therefore be appreciated that the normal sequence of operation for replacement of a cartridge of ribbon which has been exhausted through typing is to first squeeze together simultaneously the two sets of fingers 182 at each end of the locator means 32, thus releasing the notches 183 from the pins 184, and pulling vertically upward on the locater means 32, so that it is released from the typing machine, and then detaching the cartridge 28 from the cartridge pocket 30. This cartridge may then be set aside and a new one inserted in the reverse sequence. It will furthermore be apparent that the provision of a relatively rigid locator means with mounting structure at each end thereof means that the cartridge may be replaced without the operator's having to touch the ribbon or to thread it around any guides, posts, pulley or the like, thus avoiding any chance of causing the operator to bring his or her fingers into contact thereof and smudging the work or dirtying the typing machine.

Furthermore, it will be appreciated by those skilled in the art that the problem of mounting a web or ribbon in juxtaposition to a point of use is a problem broader than the printing machine art. In fact, mounting structure such as that disclosed herein may have applicability in other related fields, such as, for example, that of magnetic tape for the storage of digital or analog data of various types. Such tapes are frequently very delicate and it is desirable that they be made and stored in such a way that they need not be touched by an operator to mount or dismount new tapes. Further, it is sometimes desirable that these magnetic tapes be largely stored in a stationary container while a small fraction thereof is moved with respect to some fixed point of use, perhaps a recording head; in this connotation the cartridge/-leader/locating means system as disclosed in FIG. 2 above may find utility.

Therefore, it will be understood that the description of the invention given above is to be taken as exemplary only and not as a limitation on its scope, which is more properly defined by the following claims.

I claim:

1. In a ribbon supply assembly for supply of ribbon to a point of action comprising a housing for containing ribbon having opposing faces, ribbon locating means for supporting said ribbon while in the vicinity of said point of action and leader means connecting said locating means with said housing and for conveying ribbon therebetween, the improvement in said locating means comprising end portions adapted to detechably mate with mounting means, said end portions being formed of a resilient material and having finger-contacting means extending outwardly away from said ribbon faces on one side thereof and regions of flexure formed therein, whereby upon application of pressure to said finger-contacting means in a direction substantially parallel with the direction of ribbon conveyance through said locating means said end portions are resiliently flexed about said regions of flexure, permitting said end portions to be detached from said mounting means.

2. The assembly of claim 1, wherein said ribbon is a typing ribbon, and said point of action is a printing loation.

3. The assembly of claim 2 wherein said end portions are separated by a relatively rigid central section of said locating means, defining said printing location.

4. The assembly of claim 1 wherein said leader means are flexible and define a ribbon path which can vary as said locating means moves with respect to said housing.

5. The assembly of claim 1 wherein said finger-contacting means comprises a pair of opposing fingers at each of said end portions, said opposing fingers extending transverse to the direction of ribbon conveyance and said end portions include elongated openings for said mating extending generally in the direction of ribbon conveyance, said regions of flexure being located at one end of each of said elongated openings.

6. In a ribbon locating bridge for exposure of a ribbon face at a point of action said bridge comprising at least one portion for detachable engagement with mounting structure comprising a finger-engaging means extending away from said ribbon face on one side thereof and flexible mating means coupled to said finger-engaging means for mating with a corresponding portion of said mounting structure whereby upon the application of force to said finger-engaging means in a direction parallel to the ribbon at said point of action the flexible mating means flexes thus disengaging the at least one portion of said bridge from said mounting structure.

7. The bridge of claim 6 wherein said bridge comprises a central section and end substantially symmetric about said central section, each end comprising finger-engaging and flexible mating means, each control section including an area, whereby a portion of said ribbon is exposed between said ends.

8. The bridge of claim 6 wherein said ribbon is a printing ribbon and said point of action is a printing location.

9. The bridge of claim 8 wherein said mounting structure is mounted on printer means comprised by a typewriter.

10. The bridge of claim 6 wherein said finger-engaging means comprising a pair of opposing fingers extending transverse to the direction of ribbon conveyance and said flexible mating means includes an elongated opening extending generally in a direction of ribbon conveyance, said regions of flexure being located at one end of said elongated opening.

11. An improved ribbon system of the type comprising a housing containing ribbon having two opposing faces;

ribbon support means; and leader means interconnecting said housing and said ribbon support means, and conveying ribbon therebetween, said ribbon support means comprising end portions and a central section for conveying ribbon therethrough, said end portions being suitable for mating with said leader means and comprising means for detachable mating with mounting structure, said means for detachable mating comprising:

engagement regions shaped to mate with correspondingly-shaped regions of said mounting structure, said engagement regions being flexible between a fixed position and a released position whereby said bridge may be detached from said mounting structure by flexing said engagement regions from the fixed to the released position and finger-contacting means extending transverse to said faces of said ribbon on one side thereof at said ribbon support means and coupled to said engagement regions for flexing said engagement region in response to pressure on said finger-contacting means in a direction parallel with said conveying of ribbon.

12. The system of claim 11, wherein said leader means is flexible, and permits relative motion of said support means and said housing.

13. The system of claim 12, wherein said engagement regions are formed so as to define a protuberance engaging a region of reduced diameter on said mounting structure.

14. The system of either claims 11 or 12 where said ribbon is a typing ribbon and said ribbon support means exposes said ribbon to impact printing means.

15. The improved ribbon system of claim 11 wherein said finger-contacting means comprises two pairs of opposing fingers extending transverse to the direction of said ribbon and said engagement regions include elongated openings which meet with said correspondingly-shaped regions of said mounting structure, said elongated openings extending generally in the direction of the ribbon, said regions of flexure being located at one end of each of said elongated openings.

* * * * *